US008468994B2

(12) United States Patent
Becker et al.

(10) Patent No.: US 8,468,994 B2
(45) Date of Patent: Jun. 25, 2013

(54) LUBELESS VALVE ASSEMBLY FOR ENGINE

(75) Inventors: Edward P. Becker, Brighton, MI (US); Anil K. Sachdev, Rochester Hills, MI (US); Emerson J. Adams, Sterling Heights, MI (US); Thomas A. Perry, Bruce Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 262 days.

(21) Appl. No.: 13/020,336

(22) Filed: Feb. 3, 2011

(65) Prior Publication Data

US 2012/0199093 A1 Aug. 9, 2012

(51) Int. Cl.
*F02N 3/00* (2006.01)

(52) U.S. Cl.
USPC ..... 123/188.6; 123/188.3

(58) Field of Classification Search
USPC ..... 123/188.5, 188.6, 188.9
See application file for complete search history.

(56) References Cited

U.S. PATENT DOCUMENTS

| | | | | |
|---|---|---|---|---|
| 5,295,461 | A | 3/1994 | Rao et al. | 123/188.009 |
| 5,507,257 | A | 4/1996 | Sakai et al. | 123/188.3 |
| 5,655,493 | A | 8/1997 | Enright et al. | 123/188.3 |
| 5,819,774 | A | 10/1998 | Beardsley et al. | 137/1 |
| 5,960,760 | A | 10/1999 | Wang | 123/188.3 |
| 6,012,703 | A | 1/2000 | Hayashi et al. | 251/368 |
| 6,125,810 | A | 10/2000 | Haselkorn | 123/188.9 |
| 7,040,601 | B2 | 5/2006 | Chikahata et al. | 251/368 |
| 2004/0069262 | A1 | 4/2004 | Mihara et al. | 123/188.9 |

*Primary Examiner* — Noah Kamen

(57) ABSTRACT

A valve assembly includes a tubular valve stem guide and a valve having a valve stem slidable in the bore of the valve stem guide. A lower valve stem seal has an annular body surrounding the valve stem and a skirt sealing with the valve stem guide. An upper valve stem seal has an annular body sealingly mounted on the valve stem and a skirt portion overlapping with the annular body of the lower valve stem seal during the reciprocating movement of the valve stem so that the upper and lower valve stem seals cooperate to prevent flow of oil to the bore of the valve stem guide. The valve stem is coated with a diamond-like carbon coating or a hard nitride coating, and the valve stem guide is of powered metal construction with approximately 1% by weight solid lubricant such as molybdenum disulfide or tungsten disulfide.

5 Claims, 1 Drawing Sheet

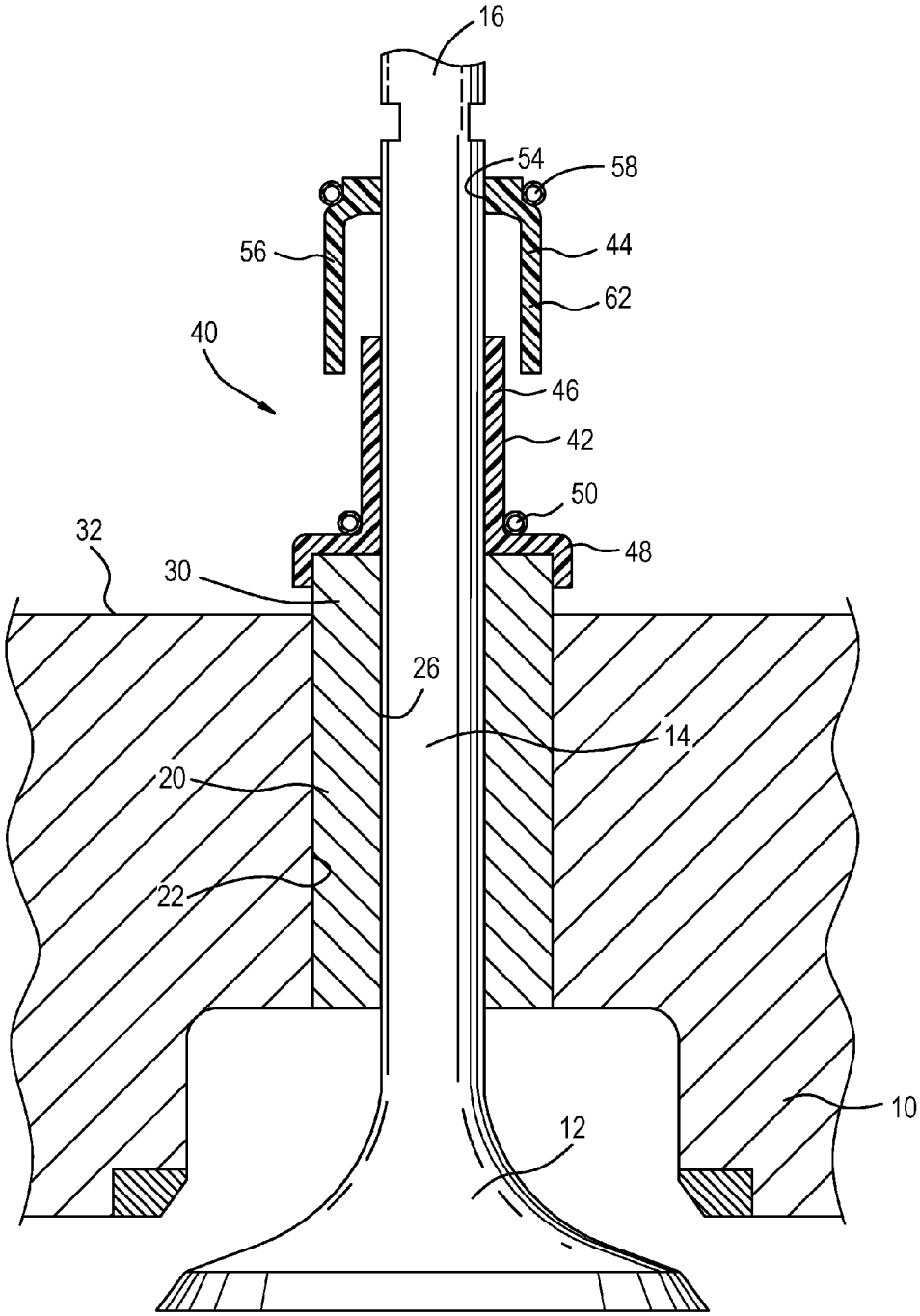
16
54
58
56
44
62
40
46
42
50
32
48
30
26
14
20
22
10
12

LUBELESS VALVE ASSEMBLY FOR ENGINE

FIELD OF THE INVENTION

The invention relates to a valve assembly for a vehicle engine and more particularly provides a lubeless valve assembly.

BACKGROUND OF THE INVENTION

Vehicle engines typically have a valve assembly that includes a valve guide mounted in the cylinder head and a valve having a stem that slides and reciprocates within a bore of the valve guide. Lubricating oil is splashed or misted onto the reciprocating valve stem to lubricate the interface between the valve guide and the valve stem. Although such lubrication is desirable for low friction and long life of the valve assembly, it is known that the consumption of oil through even the slowest attainable leakage between the stem and the seal can, over time, both consume oil and also lead to fouling of the catalytic converter.

It would be desirable to provide a valve guide assembly which would substantially eliminate oil consumption and yet still provide low friction and long life of the stem and seal components.

SUMMARY OF THE INVENTION

A valve assembly for an engine includes a tubular valve stem guide seated in the engine head and having a bore, and a valve having a valve stem reciprocably slidable in the bore of the valve stem guide. A lower valve stem seal has an annular body sealing with the valve stem and skirt at the lower end of the lower valve stem seal overlying the valve stem guide. An upper valve stem seal has an annular body sealingly mounted on the valve stem for reciprocating movement with the valve stem and including a skirt portion at the lower end thereof overlapping the lower valve stem seal during the reciprocating movement; whereby the upper and lower valve stem seals cooperate to prevent flow of oil to the bore of the valve stem guide. The valve stem is coated with a diamond-like coating or a hard nitride coating, and the valve stem guide is of powdered metal construction with approximately 1% by weight solid lubricant such as molybdenum disulfide or tungsten disulfide.

BRIEF DESCRIPTION OF THE DRAWINGS

The present invention will become more fully understood from the detailed description and the accompanying drawing.

the FIGURE is a side elevation view of a engine valve assembly according to the invention.

DETAILED DESCRIPTION OF THE EXEMPLARY EMBODIMENTS

The following description of certain exemplary embodiments is merely exemplary in nature and is not intended to limit the invention, its application, or uses.

Referring to the FIGURE, a vehicle engine includes a cylinder head 10, typically of aluminum or iron in which a valve 12 is provided.

The valve 12 has an axially extending valve stem 14 having an uppermost end 16 that is connected to a camshaft by rocker assembly, not shown.

Tubular valve stem guide 20 is press fit into a bore 22 of the cylinder head 10. The valve stem guide 20 has an internal bore

26 that closely receives the valve stem 14 of the valve 12. The valve stem guide 20 is typically press fit into the cylinder head 10 with an upper extending portion 30 of the valve stem guide 20 projecting somewhat above a top surface 32 of the cylinder head 10. Thus, the valve stem guide 20 mounts the valve stem 14 for reciprocating up and down movement of the valve 12 within the cylinder head 10.

Referring again to the FIGURE a valve stem seal assembly, generally indicated at 40, is provided to shield the valve stem 14 from exposure to engine oil that is splashing about as required to lubricate the rocker arm assembly and camshaft. This seal assembly 40 includes a lower seal 42 and an upper seal 44.

The lower seal 42 is of molded elastomeric material and includes an annular body 46 that tightly surrounds the valve stem 14. The lower seal 42 includes a skirt portion 48 at the lower end of the annular body 46. The skirt portion, as shown in the FIGURE, fits tightly around the outside of the upper extending portion 30 of the valve guide 20, and is preferably tightly fitted onto the upper extending portion 30. Although not shown in the drawings, the upper extending portion 30 of the valve guide 20 can have a groove or a lip that fits into a corresponding lip or groove on the skirt portion 48 to assist the tight fitting attachment of the lower seal 42 to the valve guide 20. A garter spring 50 surrounds the annular body 46 to help assure an oil tight relationship between the valve stem 14 and the lower seal 42 so that no oil enters the space between the valve stem 14 and the bore 26 of the valve stem guide 20.

The upper seal 44 also has an annular body 56 and is likewise molded of an elastomeric material. The uppermost end of the annular body 56 includes a bore 54 that tightly press fits onto the outside surface of the valve stem 14. A garter spring 58 assists in retaining the upper seal 44 on the valve stem 14 and assures an oil tight relationship between the bore 54 of the upper seal 44 and the valve stem 14. The lowermost portion of the annular body 46 is a skirt portion 62 that surrounds and overlaps the annular body 46 of the lower seal 42. The annular body 46 of the lower seal 42 and the skirt portion 62 of the upper seal 44 each have a length sufficient to assure that throughout the reciprocating range of movement of the valve stem 14 the upper seal 44 and lower seal 42 will overlap one another to prevent oil from splashing onto the valve stem 14.

Thus, it will be understood that the lower seal 42 and the upper seal 44 cooperate to starve the interface between the valve stem 14 and the bore 26 of the valve guide 20 from exposure to the oil that was required for lubrication of the rocker assembly. In order to provide for low friction and long life action between the valve stem 14 and the valve guide 20, these components are specially constructed to function in a lubeless environment.

The valve stem is coated with a low friction coating. For example the valve stem is coated with a diamond-like carbon coating. Or the valve stem is coated with a hard nitride. The valve guide 20 is made of sintered powder metal that includes a solid lubricant of approximately 1% by weight. The solid lubricant can be, for example, molybdenum disulfide or tungsten disulfide.

Thus, the invention provides a new and improved engine valve assembly having advantages of low oil consumption and low friction and long usage.

What is claimed is:

1. A valve assembly for an engine comprising:

a tubular valve stem guide seated in the engine head and having a bore;

a valve having a valve stem reciprocably slidable in the bore of the valve stem guide;

a lower valve stem seal having an annular body sealingly surrounding the valve stem and a skirt at the lower end of the lower valve stem seal overlying the valve stem guide and sealing therewith;

and an upper valve stem seal having an annular body sealingly mounted on the valve stem for reciprocating movement with the valve stem and including a skirt portion at the lower end thereof overlapping with the annular body of the lower valve stem seal during the reciprocating movement; whereby the upper and lower valve stem seals cooperate to prevent flow of oil to the bore of the valve stem guide.

2. The valve assembly of claim 1 further comprising: said valve stem being coated with a diamond-like carbon coating or a hard nitride coating.

3. The valve assembly of claim 1 further comprising said valve being of powered metal construction with approximately 1% by weight solid lubricant such as molybdenum disulfide or tungsten disulfide.

4. The valve assembly of claim 1 further comprising: said valve stem being coated with a diamond-like carbon coating or hard nitride coating and said valve being of powered metal construction with approximately 1% by weight solid lubricant such as molybdenum disulfide or tungsten disulfide.

5. A valve assembly for an engine comprising:

a tubular valve stem guide seated in the engine head and having a bore;

a valve having a valve stem reciprocably slidable in the bore of the valve stem guide;

a lower valve stem seal having an annular body sealingly surrounding the valve stem and a skirt at the lower end of the lower valve stem seal overlying the valve stem guide and sealing therewith;

and an upper valve stem seal having an annular body sealingly mounted on the valve stem for reciprocating movement with the valve stem and including a skirt portion at the lower end thereof overlapping with the annular body of the lower valve stem seal during the reciprocating movement; whereby the upper and lower valve stem seals cooperate to prevent flow of oil to the bore of the valve stem guide;

said valve stem being coated with a diamond-like carbon coating or a hard nitride coating, and said valve being of powered metal construction with approximately 1% by weight solid lubricant such as molybdenum disulfide or tungsten disulfide.

* * * * *